United States Patent [19]

Orban

[11] Patent Number: 4,837,824

[45] Date of Patent: Jun. 6, 1989

[54] STEREOPHONIC IMAGE WIDENING CIRCUIT

[75] Inventor: Robert A. Orban, Belmont, Calif.

[73] Assignee: Orban Associates, Inc., San Francisco, Calif.

[21] Appl. No.: 162,978

[22] Filed: Mar. 2, 1988

[51] Int. Cl.[4] ..... H04S 1/00

[52] U.S. Cl. ..... 381/1

[58] Field of Search ..... 381/1, 19, 22, 23

[56] References Cited

U.S. PATENT DOCUMENTS 4,704,728 11/1987 Scheiber ..... 381/22

4,748,669 5/1988 Klayman ..... 381/66

*Primary Examiner*—Forester W. Isen

*Attorney, Agent, or Firm*—Blakely, Sokoloff, Taylor & Zafman

[57] ABSTRACT

A circuit for providing enhanced stereophonic sound by processing the L−R signal. A compressor which receives the L+R signal provides a gain control signal. This signal controls the level of the L−R signal and the gain in a tracking VCA. The tracking VCA receives the enhanced L−R signal and under predetermined conditions prevents increasing the level of the L−R signal.

16 Claims, 2 Drawing Sheets

+15V
100K
81
42
41
47K
75
1/4 339
73
80 (2N4402)
69
10K
150K
0.1
72
-15V
100K
330Ω
10M
65
"MONO" DETECTOR
65a
65b
EXCESSIVE L-R/L+R RATIO DETECTOR
±HIGH WINDOW LEVEL
±LOW LEVEL
51
1/2 412
1M
0.1 μF
10M
0.039 μF
62
1/2 072
1000Pf
0.01μF
10.5K
BAND-PASS FILTER
5.76K
0.01μF
8.25K
1K
1.5μF
63

STEREOPHONIC IMAGE WIDENING CIRCUIT

BACKGROUND OF THE INVENTION

1. Field of the Invention.

This invention is in the field of circuits that dynamically enhance a two-channel stereophonic sound signal such as the stereophonic sound images produced by loudspeakers or headphones. These circuits enhance the sound by generally making it wider and more spacious.

2. Prior Art.

Often stereophonic image widening circuits are designed to ensure monophonic compatibility when the stereophonic signal is broadcast. That is, the sum of the left and right stereophonic channels (often termed "L+R") is not affected by the processing, and the circuit does not significantly affect the peak modulation level of a standard FM stereophonic broadcasting system. This ensures that full modulation is retained for listeners with monophonic receivers, and that the modulation accurately represents the sum of the original left and right channels.

In general, the prior circuits can be divided into two classes: (1) those which process the signal in such a way that the L+R signal is affected by the processing, and (2) those which process the signal such that L+R is unaffected. In the latter case, only the stereophonic difference signal (L−R) is affected. (For convenience, these latter circuits are referred to as having "unaffected L+R".) The present invention is in this latter category.

The simplest form of circuit with unaffected L+R(Prior Art Circuit 1) matrixes the stereophonic signal into sum-and-difference (L+R/L−R) form, amplifies the L−R signal, and then re-matrixes the amplified L−R and the original L+R into an enhanced discrete left and right (L/R) form.

Mathematically, if the gain applied to the L−R signal is k, then enhanced $L=0.5(L+R)+0.5k(L-R)=0.5k(k+1)-0.5R(k-1)$, and enhanced $R=0.5(L+R)-0.5k(L-R)=0.5R(k+1)-0.5L(k-1)$ $k=1$ for no enhancement Thus, this enhancement process has two effects: (1) it increases the level of the desired channel by a gain factor of $0.5(k+1)$ and (2) it introduces out-of-polarity crosstalk from the undesired channel at a gain of $0.5(k-1)$. It is the introduction of out-of-polarity crosstalk symmetrically into the opposite channel that causes the perceived widening on the stereophonic image.

While the relatively simple processing of this Prior Art Circuit 1 does indeed increase the perceived width of the signal, it suffers from two problems that make it unsuitable for broadcast use:

First, if the level of the L−R signal prior to processing is a significant fraction of the level of the L+R signal, then after processing, the level of the L−R signal can substantially exceed the level of the L+R signal. This is not a satisfactory situation in FM stereo broadcasting by the world-standard "pilot-tone" method. The difficulty arises because the peak modulation of the stereophonic composite baseband signal is proportional to the peak level of the higher of the left or right channels. Examination of the mathematical expressions for the enhanced L and enhanced R signals above shows that the levels of these signals increase with increasing k. The factor by which the peak level increases can be as large as $0.5(1+k)$. Meanwhile, because the Prior Art Circuit 1 operates only the L−R signal, the level of the L+R is not affected. If, after processing, the level of the L−R signal is significant by comparison to the level of the L+R signal, the peak levels of the enhanced left and right signals (and thus the peak level of the stereophonic composite baseband signal) are increased. This occurs without any corresponding increase in the level of the L+R signal. Because the peak level of the composite baseband signal must be constrained so that it does not exceed a certain level (determined usually by government broadcasting authorities so that interference to adjacent channels is prevented), this means that the potential overall L+R modulation is reduced by addition of excessive L−R level. This reduces the loudness and signal-to-noise ratio available at monophonic receivers, which reproduce only the L+R signal. This situation is unacceptable to broadcasters.

As a matter of good engineering practice, the L−R to L+R ratio should be constrained to unity if the signal is to be considered "broadcastable". (This corresponds to a signal in only one stereophonic channel.)

A second problem with the Prior Art Circuit 1 involves reverberation and other ambient sounds which often have most of their energy in the L−R channel. Fixed-gain amplification of the L−R channel has the effect of exaggerating reverberation and ambience, sometimes to the point of making the signal sound excessively reverberant or "muddy". In addition, the L−R channel is more likely than the L+R channel to suffer from noise and distortion, particularly if its source is a phonograph record. Fixed-gain amplification of the L−R channel can unpleasantly exaggerate such noise and distortion as well.

Another prior art circuit (Prior Art Circuit 2) solves the problems discussed above for Prior Art Circuit 1 by placing a voltage-variable-gain amplifier (VCA) in series with the L−R signal path. The gain of the VCA is reduced whenever a control means that monitors the ratio of L−R to L+R determines that this ratio is too high (usually meaning greater than unity).

Additional control means are used to reduce the gain of the VCA when the input signal is determined to be monophonic (usually, by measuring the ratio of L−R to L+R and assuming that the signal is monophonic if this ratio is sufficiently small). In this case, any small amount of residual L−R is assumed to be noise or an artifact of slight imbalance between the gains or phases of the left and right channels. It is clearly undesirable to amplify such noise or to exaggerate any channel imbalance errors.

In a variation of Prior Art Circuit 2, the L−R signal only is extracted from the original left and right signals by means of a matrix. (The L+R signal is not derived.) The L−R signal is applied to a VCA, the output of which ("incremental enhanced L−R") is added to the original left channel and subtracted from the original right channel to form enhanced left and right channels. It can be shown that this is mathematically identical to the process of extracting the L+R and L−R signals, amplifying the L−R signal, and re-matrixing to form the enhanced left and right signals:

enhanced $L=L+c(L-R)=L(1+c)-cR$, and enhanced $R=R-c(1-R)=R(1+c)-cL$ where c is the gain of the VCA (c=o for no enhancement).

For equivalent ratios of original-to-crosstalk signals Prior Art Circuit 1 and this variation to Prior Art Circuit 2, $c=(1-k)/2k$ where k is as defined above for Prior Art Circuit 1.

While, in this variation of the Prior Art Circuit 2, the level of the enhanced L−R signal can never be less than the level of the original L−R, this is satisfactory because the object of the circuit is to enhance the L−R signal; the L−R signal is never reduced in level. The advantage of this circuit is that only the incremental enhanced part of the L−R signal is passed through the VCA (not the entire L−R signal), and thus any noise and/or distortion contributed by the VCA are applied only to the incremental enhanced portion of the L−R signal. A further advantage is that when the gain of the VCA is zero, perfect separation is achieved at the circuit's output: there is no possibility of loss of separation due to errors in matrix and dematrix circuitry.

Still another variation of Prior Art Circuit 2 firstr applies the L−R signal to a delay line. The original L−R signal and its delayed version are comboned in userdetermined proportion, and then applied to a VCA that operates in the same manner as in the preferred circuit described immediately above. Thus the incremental enhanced L−R may consist not only of a signal directly proportional to the original L−R, but also to the original L−R as applied to a time delay means.

Neither of the variations to Prior Art Circuit 2 sloves the second problem discussed above for the Prior Art Circuit 1 (excessive exaggeration of reverberation and ambience) because the gain of the L−R channel is always greater than unity.

OBJECTS OF THE PRESENT INVENTION

Among the objects of the present invenition is to provide a stereophonic sound field enhancer compatible with conventional FM stereophonic transmission systems, that prevents unnaturally exaggerating reverberation and ambience, and that operates well over a relatively wide range of input levels.

SUMMARY OF THE PRESENT INVENTION

A circuit for enhancing sterophonic sound by processing the L−R signal is described. A first means for developing a control signal which varies as a function of the attack transients of the L−R signal is used. The control is is used to control the gain of the L−R signal in a second means.

In the presently preferred embodiment, the second means comprises a VCA which receives the L−R signal as an input and provides an incrementally enhanced L−R signal as an output. The first means in the presently preferred embodiment comprises a compressor coupled to receive the L+R signal. The compressor includes a tracking VCA which receives the enhanced L−R signal as an input. The gain of this VCA is controlled by the compressor control signal. A window comparator means provides an output signal when the ratio of the compressed enhanced L−R signal and the L+R signal (this ratio is the output of the tracking VCA) is not within the upper and lower limits of the window. This output signal is used to control a switch that limits the gain of the first VCA. In this manner, the compressor serves two simultaneous functions. It permits operation of the switch over a wide range of operating levels and it permits derivation of the attack transient over a wide range of operating levels.

Other aspects of the present invention will be described in the detailed description of the invention.

DETAILED DESCRIPTION OF THE PRESENT INVENTION

Figure 1:
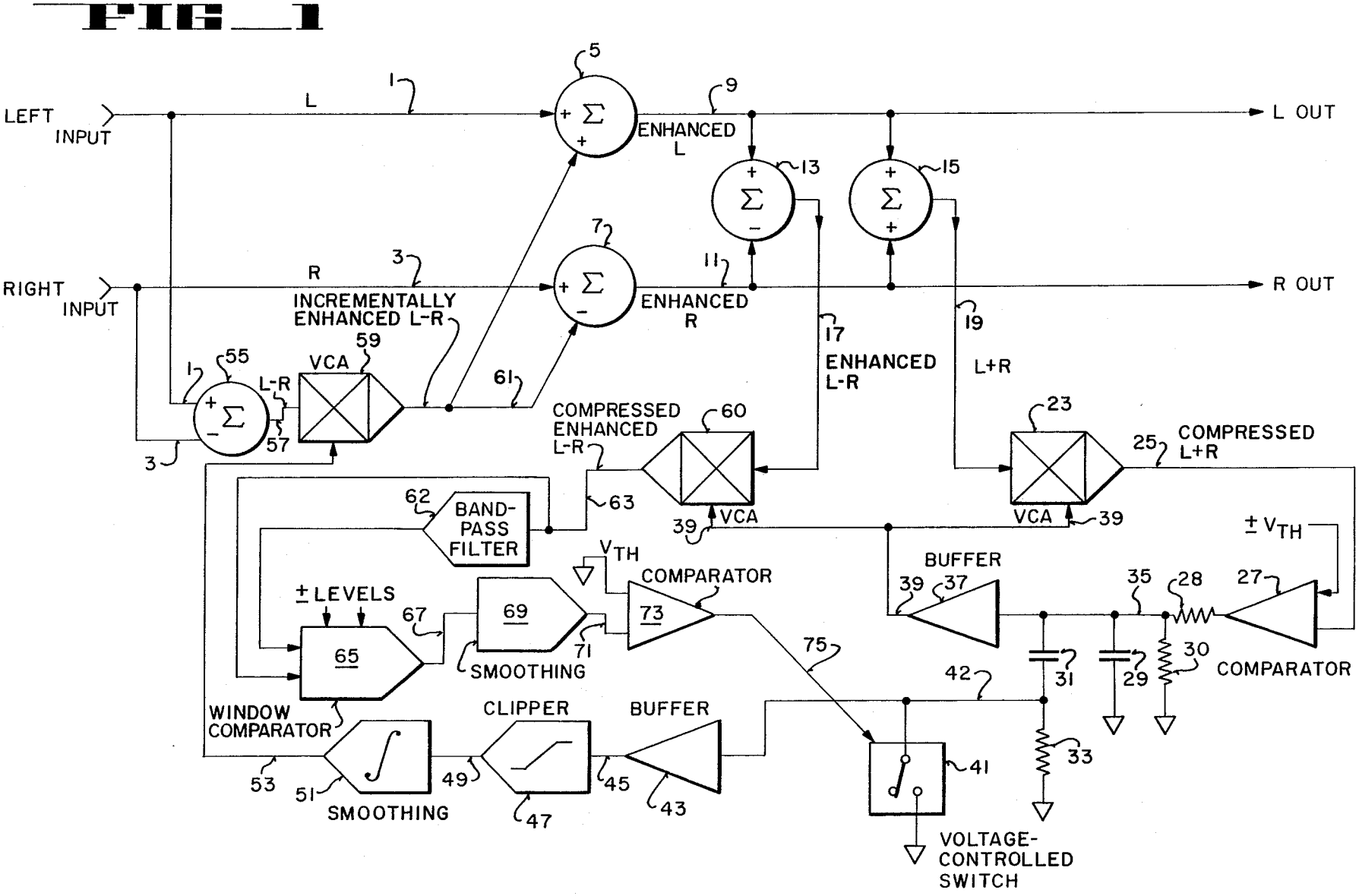
FIG. 1 is a block diagram of the presently preferred embodiment of the present invention.

A circuit for enhancing stereophonic sound by processing the L−R signal is described. In the following description, numerous specific details are set forth including specific electrical schematics in order to provide a thorough understanding of the present invention. It will be obvious, however, to one skilled in the art that these details need not be employed to practice the present invention. In other instances, well-known circuits such as those that are commerically availalbe are not shown in detail in order not to unnecessarily obscure the present invention.

OVERVIEW OF THE PRESENT INVENTION

Conceptually, the present invention is of the general form as the Prior Art Circuit 2. One novelty of the invention is the means by which a control signal is derived that determines the amount of incremental enhanced L−R signal (control signal to VCA 59 of FIG. 1) and the way that this signal is used.

Psychoacoustic research has established that, in speech and music, the initial attack transient of a sound is most important in subjectively determining the localization of the sound. While the ear can also determine the localization of steady-state sound, it does so with more difficulty.

The present invention derives from the envelope of the L+R signal a control signal approximately proportional to the magnitude of the attack transients within that signal. (More precisely, the control signal is approximately proportional to the differentiated logarithm of the envelope of the L+R signal.) It uses this control signal to determine the gain of the L−R VCA 59. Thus enhancement occurs approximately in proportion to the magnitude of the detected attack transients.

When no attack transients are detected, the gain of the incremental enhanced L−R VCA is zero, and no enhancement occurs. Therefore, the circuit does not exaggerate reverberation decays and ambient sound, because these sounds are essentially transient-free The attack transients are derived from the gain control voltage developed by a compressor, the gain of which is controlled by the peak level of the L+R signal such that the peak levle remains constant at the compressor's output. The compressor includes a tracking VCA 60 which processes the enhanced L−R signal such that the enhanced L−R, as scaled by the peak level of the L+R signal is applied to a window comparator means 65. The window comparator means determines if the ratio of the enhanced L−R to L+R signal are within a certain level ("window"). If this ratio exceeds a threshold of approximately unity, the enhancement circuitry "gated" by the window comparator means to prevent further increases in ratio. Conversely, if the ratio is too low, the circuit assumes that the input signal to the enhancer circuit is monophonic, and "gates" the enhancer to prevent it form increasing either such slight residual channel imbalwnces as may exist, or L−R noise. The compressor this serves two simultaneous functions: (1) it permits operation of the "gating" function over a wide range of operating levels, and (2) it permits derivation of the attack transient over a wide range of operating levels.

BLOCK DIAGRAM OF FIG. 1

The left and right input audio signals are coupled to lines 1 and 3, respectively. Line 1 is coupled to the positive terminals of the summer 5 and summer (differencing means) 55; line 3 is coupled to the positive terminal of summers 7 and the negative terminal of summer 55. The enhanced left and right output signals are obtained on lines 9 and 11, respectively. The summer 13 provides an enhanced L−R signal to the input of the VCA 60; summer 15 provides the L+R signal to the input of the VCA 23 (note the L+R signal is not enhanced and could as well be obtained from lines 1 and 3).

The enhanced L−R signal is developed by a voltage controlled amplifier (VCA 59) which is an ordinary commercially available VCA such as Part No. CA3280 (GE/RCA Solid State). This VCA is controlled by the signal on line 53. The input to the VCA 59 is the L−R signal on line 57; the output is the incrementally enhanced L−R signal on line 61. Line 61 is coupled to the positive terminal of summer 5 and the negative terminal of summer 7. These summers provides the final enhanced L and R signals on lines 9 and 11, respectively The compressor generally includes the VCA 23 which receives as an input the L+R signal and the output of which via line 25 provides a control signal (albeit processed as will be described) for the VCAs 23, 59 and 60.

Line 25 is coupled to a comparator 27 which is an ordinary available part (Part No. LM339 from National Semiconductor, Inc.). The comparator compares the input signal with a fixed threshold as will be described. The output of the comparator 27 is coupled to line 35 through resistor 28 which determines the attack time of the compressor. Resistor 28 is coupled to line 35 to drive an ordinary buffer 37. The buffer (line 39) is coupled to the control terminals of the VCAs 23 and 60. Line 35 is coupled to ground through resistor 30 and capacitor 29 and to the voltage controlled switch 41 through capacitor 31. The capacitor 31 is coupled to ground through resistor 33. As will be described later, the switch 41 selectively couples the conrol signal on line 42 to ground when the input to the comparator 65 exceeds or falls below levels which define a window.

Line 42 is coupled to the input of a buffer 43. The output of this buffer, line 45, is coupled through a clipper which is an ordinary diode clipper. The output of the clipper, line 49, is coupled through a smoothing network 51, and the output of this network provides the control signal on line 53 to the VCA 59. This smoothing network 51 is shown in detail FIG. 3.

The compressed enhanced L−R signal on line (output of VCA 60) is coupled to the input of a bandpass filter 62 and to the window comparator 65. The output of this filter is also coupled to a window comparator 65. The output of the window comparator, line 67, is coupled to a smoothing network 69 with the output of this network being coupled via line 71 to a comparator 73. The comparator 73 which is an ordinary part (Part No. LM339 ) has its other terminal coupled to ground. The output of the comparator controls the switch 41. The lowpass filter 62, window comparator 65, smoothing network 69, comparator 73 and switch 41 are shown in detail in FIG. 2.

OPERATION OF THE PRESENT INVENTION

Referring to FIG. 1, the unenhanced left and right stereophonic signals are applied on lines 1 and 3, respectively, as mentioned. These signals are also applied to summer (differencing means) 55 by which the L−R signal are also applied to summer (differencing means)55 by which the L−R signal is derived. VCA 59 provides a variable gain for the L−R signals, thereby providing the enhancement. The output of VCA 59 is the "incremental enhanced L−R" signal. This signal is summed with the unenchanced left signal in summer 5 and subtracted from the unenhanced right signal in summer (differencing means) 7 to produce the "enhanced left" and "enhanced right" signals on lines 9 and 11, respectively.

The L+R signal on line 19 is applied to the input of the L+R control VCA 23. This VCA has a "decilinear" control signal characteristic: the gain (in dB) of the VCA is directly proportional to the control signal on line 39.

The compressed L+R signal at the output of VCA is coupled to the "comparator-with-threshold" 27. This comparator produces a negative-going current on line 35 each time the absolute peak value of the signal on line 25 exceeds the present threshold. This current charges capacitors 29 and 31 in the negative direction until the peak levle on line 25 is reduced below the threshold of comparator 27. Resistor 30 permits the gain of VCA to recover towards its quiescent value in the absence of signals above the threshold of comparator 27. Resistor 28 determines the attack time of the compressor by limiting the current charging capacitors 23 and 31.

The reduction in the peak level of the signal on line 25 is achieved by gain reduction in VCA 23, as affected by the control signal on line 39. Thus, the peak level of the signal on line 25 is held substantially constant by feedback.

The loop consisting of: VCA 23; comparator 27; the time constant determined by resistors 28, 30 and 33, and capacitor 29 and 31; the buffer 37; and, line 39 is generally known as a "feedback compressor". This has an essentially infinite compression ratio: its peak output level is held substantially constant over a range of input levels of approximately 25dB.

A control signal proportional to the attack transients is derived across resistor 33 from this compressor. The control signal is AC-coupling from the compressor's gain-control signal through capacitor 31 into buffer 43, clipper 47, and further smoothing by network 51. In fact, the control signal coupled to VCA 59 (less the clippong and smoothing) si approximately proportional to the logarithm of the envelopes of the L+R signal differentiated by the highpass filtering of capacitor 31 and resistor 33.

Clipper 47 clips off the excessive part of large attach transients which would otherwise cause unnatural overenhancement of the stereophonic signal. Smoothing network 51 provides an approximate 100 millisecond "peak hold" function for the signal on line 49, followed by a smooth exponential decay with a time constant of approximately 200 milliseconds.

Line 53 is connected to the gain control terminal of VCA 59. In the preferred embodiment, VCA 59 is not "decilinear". Instead, its voltage gain is directly proportional to the control signal on line 53 (in contrast to VCA 23).

The attack tranients derived by the compressor are primarily determined by the response of comparator 27 to it input on line 25. Because long-term level variations have been removed from the signal on line 25 by the action of the compressor, comparator 27 responds consistently to attack transients over a wide range of circuit operating levels. Such consistency is further ensured range of circuit operating levels. Such consistency is further ensured by the fact that the signal on line 35 is proportional to the gain (in dB) of VCA 23. This "decilinear" characteristic forces a given change in level on line 25 (in dB) to always produce the same change in the control signal level on line 35, regardless of the average DC level on line 35.

The enhanced L−R signal is derived from the signals on lines 9 and 11 by differencing means 13, and appears on line 17. Line 17 is applied to the input of VCA 60. VCA 60's characteristics are matched to those of VCA 23. The gain-control signal on line 39 is applied to the gain control input or VCA 60; its gain thus tracks the gain of VCA 23. The signal on line 17 is consequently scaled by the gain necessary to hold constant the peak L+R level. The output of VCA 60 on line 63 is therefore a compressed enhanced L−R signal, and represents the ratio of the enhanced L−R to the L+R signal.

The compressed enhanced L−R signal is applied to window comparator 65 (ignoring for the present, the filter 62). This circuit produces an output if the absolute value of its input is either above a first preset threshold, or below a second preset threshold. An output is thus produced on line 67 if (1) the enhanced L−R to L+R ratio exceeds the amount which can be broadcast without ill effect (first preset threshold), or (2) if said ratio is so low (second preset threshold) that there is a high probability that the input signal is monophonic and should not be enhanced.

In either case, the pulses on line 67 produced by window comparator 65 are smoothed by network 69, which can be a simple RC lowpass filter. The smoothed signal is applied to comparator means 73; its output on line 75 changes from LOW (not gated) to HIGH (gated) in a binary manner. Whether the output of comparator 73 is HIGH or LOW depends on whether the smoothed signal on line 71 is above or below the threshold of comparator 73, which in turn depends on the density of the pulses from window comparator 65. (A few isolated pulses will be insufficient to raise the output of smoothing means 69 above the threshold of comparator 73, thus preventing "falsing" of the gating function when the signal on line 63 has only a few peaks beyond the threshold of window comparator 65.) If the signal on line 75 is HIGH, it closes switch 41. This shorts the signal on line 42 to ground, and prevents any further enhancement. This is the "gated" condition.

Because further smoothing of the enhancement signal is provided in smoothing network 51, operation of switch 41 does not abruptly switch off the enhancement. In fact, when the gating circuit is controlling excessive enhanced L−R to L+R ratios, a pulse duration modulation feedback circuit is automatically set up by virtue of the circuit topology, in which the duty cycle of switch 41 is modulated such that the final gain control signal on line 53 is limited to a value that just barely causes the desired value of enhanced L−R to L+R ratio be reached.

The effects of the compressor are therefore seen to be twofold: (1) the compressor produces gating that depends only on the enhanced L−R to L+R ratio (not on the absolute level of the enhanced L−R) over a wide range of input levels, and, (2) the compressor provides a constant amount of stereo enhancement over the same wide range of levels. Thus, the input level to the circuit does not have to be well-controlled to achieve consistent results.

DETAILED CIRCUITS

Figures 2, 3:
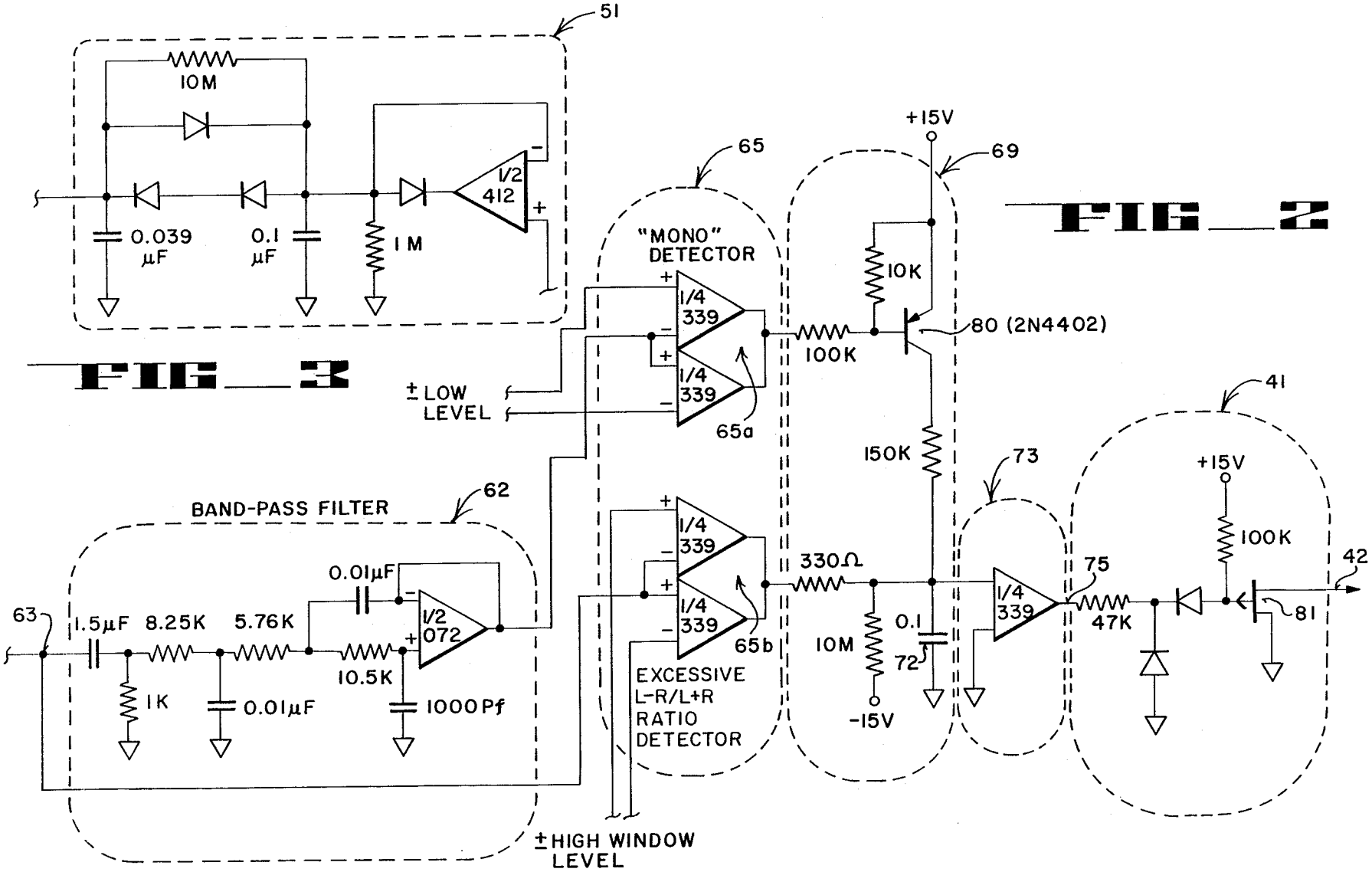
FIG. 2 is an electrical schematic of certain of the components shown in block diagram form in FIG. 1.
FIG. 3 is an electrical schematic of a smoothing network shown in FIG. 1.

Referring now to FIG. 2, the bandpass filter 62 is an ordinary filter (100 Hz/octave highpass filter cascaded with a 2 kHz, 18 dB/octave lowpass filter used to rolloff noise before the "monodetector" of the window comparator.

The window comparator 65 is fabricated from standard comparators (Part No. LM339 ). The section **65*a* of the comparator is used to detect the presence of a monophonic signal and its output is coupled by a resistor to the base terminal of the transistor 80. The section 65*b* of the window comparator which determines when the ratio exceeds a threshold of approximately unity receives an input directly from the VCA 60 (line 63**).

The smoothing network 69 is a relatively simple RC network, the output of which is coupled to the comparator 73. The pulses are "integrated" on the capacitor 72. The comparator 73 again comprises Part No. LM339. The output of the comparator is coupled to the switch 41; this switch utilizes a commercially available junction field-effect transistor 81 (Part No. J174). The control signal on line 42 is grounded through the transistor 81, as mentioned, under control of the signal on line 75.

The capacitor values shown in FIGS. 2 and 3 are in microfarads unless indicated otherwise.

Thus, a circuit that dynamically enhances a two-channel stereophonic sound signal has been described. The circuit operates on the L−R signal leaving the L+R signal unaffected. The circuited among other novel concepts uses a "upward expander" in the L−R channel to derive the enhancement. The upward expander has unity gain and increasing gain when its control signal exceeds the trigger threshold. The control signal for the upward expander is derived from an estimate of the magnitude of the attack transients in the L and R input signals. The estimate of the attack transients is derived by processing the control voltage of the compressor which operates on the L+R signal. The control voltage of the compressor is linearly proportional to the gain the dB of the compressor's VCA. The gain of the VCA that processes the enhanced L−R signal (tracking VCA) tracks the VCA in the compressor, thus deriving the ratio between the enhanced L−R and L+R signals over a wide range of input levels. A window comparator means driven by the enhanced L−R/L+R ratio provides a gating signal which controls an electronic switch. A clipper is used to prevent the attack transients in the control signal from becoming too large.

I claim:

1. A circuit enhancing stereophonic sound by processing an L−R signal, comprising:

first means for developing a control signal which varies as a function of the attack transients in an L+R signal;

second means for controlling the gain of said L−R signal as a function of said control signal, said second means being coupled to receive said control signal.

2. The circuit defined by claim 1 wherein said control signal is approximately proportional to the differentiated logarithm of the envelope of said L+R signal.

3. The circuit defined by claim 2 wherein said second means comprises a voltage controlled amplifier (VCA).

4. The circuit defined by claim 1 wherein said first means includes a signal compressor coupled to receive said L+R signal, said control signal being derived from a gain control voltage for said compressor.

5. The circuit defined by claim 4 including (1) a tracking VCA coupled to receive said gain contol voltage of said signal compressor for controlling the gain of said tracking VCA and coupled to receive as an input an enhanced L−R signal, (2) a window comparator means coupled to said tracking VCA for providing an output signal when the output of said tracking VCA falls below a first predetermined threshold or above a second predetermined threshold and (3) a switch controlled by said output signal of said comparator means, said switch for limiting the gain of said second means.

6. The circuit defined by claim 5 wherein said signal compressor includes a compressor VCA the output of which is coupled to a comparator, the output of said comparator being coupled to the control terminal of said compressor VCA.

7. The circuit defined by claim 6 wherein said tracking and compressor VCAs have the same gain characteristics.

8. The circuit defined by claim 6 wherein said gain control voltage for said compresor is linearly proportional to the gain in dB of said tracking and compressor VCAs.

9. The circuit defined by claim 6 including a circuit providing a time constant coupled to said output of said comparator.

10. A circuit for enhancing stereophonic sound by processing and L−R signal comprising:

a first VCA coupled to receive said L−R signal;

summing means coupled to the output of said first VCA for providing enhanced L and R signals;

a compressor coupled to receive an L+R signal, said compressor providing a first control signal for said first VCA;

window comparator means for providing a second control signal when the ratio of an enhanced L−R signal and said L+R signal are not within upper and lower levels of a predetermined window;

switching means for affecting the level of said first control signal, coupled to receive said first control signal, said switching being controlled by said second control signal.

11. The circuit defined by claim 10 wherein said compressor comprises a second VCA coupled to receive said L+R signal as an input, the output of said second VCA being coupled to a comparator, the output of said comparator being used to derive said first control signal.

12. The circuit defined by claim 11 wherein said output of said comparator controls the gain of said second VCA.

13. The circuit defined by claim 12 including a third VCA, the output of which is coupled to said window comparator means, said third VCA receiving said enhanced L−R signal as an input and said output of said comparator as a control signal.

14. A circuit for enhancing stereophic sound by processing an L−R signal comprising:

a compressor coupled to receive L and R sisgnals, said compressor receiving a first control signal;

an amplifier means fo rproviding gain, coupled to receive said L-R signal;

said amplifier means coupled to receive amd being controlled by a second control signal derived from said first control signal;

window comparator means coupled to receive processsed L and R signals, for providing a third control signal when a signal within said window comparator means rises above or falls below predetermined levels circuit means controlled by said third control signal, for affecting gain of said amplifier means.

15. The circuit by claim 14 wherein said circuit means comprising a switch said second control signal.

16. The circuit defined by claim by 15 wherein said second control signal is approximately proportional to the differentiated logarithm of the envelope of an L−R signal.

* * * * *

UNITED STATES PATENT AND TRADEMARK OFFICE

CERTIFICATE OF CORRECTION

PATENT NO. :4,837,824

DATED :06/06/89

INVENTOR(S) :Orban

It is certified that error appears in the above-identified patent and that said Letters Patent is hereby corrected as shown below:

| COLUMN | LINE | |
|---|---|---|
| 03 | 22 | delete "firstr" insert --first-- |
| 03 | 24 | delete "comboned" insert --combined-- |
| 03 | 49 | delete "L-R" insert --L+R-- |
| 03 | 50 | delete "is" (first occurrence) insert --signal-- |
| 04 | 02 | delete "transient" insert --transients-- |
| 04 | 24 | delete "availalbe" insert --available-- |
| 04 | 58 | delete "levle" insert --level-- |
| 05 | 04 | delete "imbalwnces" insert --imbalances-- |
| 05 | 08 | delete "transient" insert --transients-- |
| 05 | 32 | delete "provides" insert --provide-- |
| 06 | 13,14 | delete "are also applied to summer (differencing means) 55 by which the L-R signal" |
| 06 | 32 | delete "present" insert --preset-- |
| 06 | 35 | insert --23-- between "VCA" and "to" |
| 06 | 48 | insert --compressor-- between "This" and "has" |
| 06 | 58 | delete "clipong" insert --clipping-- |
| 07 | 12,13 | delete "Such consistency is further ensured range of circuit operating levels" |
| 10 | 25 | delete "sisgnals" insert --signals-- |
| 10 | 27 | delete "fo rproviding" insert --for providing-- |

UNITED STATES PATENT AND TRADEMARK OFFICE

CERTIFICATE OF CORRECTION

PATENT NO. : 4,837,824

DATED : 06/06/89

INVENTOR(S) : Orban

It is certified that error appears in the above-identified patent and that said Letters Patent is hereby corrected as shown below:

| COLUMN | LINE | |
|---|---|---|
| 10 | 29 | delete "amd" insert --and-- |
| 10 | 43 | delete "L-R" insert --L+R-- |

Signed and Sealed this

Twentieth Day of February, 1990

*Attest:*

JEFFREY M. SAMUELS

*Attesting Officer*

*Acting Commissioner of Patents and Trademarks*